US005152107A

United States Patent [19]

Strickert

[11] Patent Number: 5,152,107

[45] Date of Patent: Oct. 6, 1992

[54] SNOW BLOCKING DEVICE FOR ATTACHMENT TO CORRUGATED METAL ROOFS

[75] Inventor: Lawrence F. Strickert, Lombard, Ill.

[73] Assignee: Thybar Corporation, Addison, Ill.

[21] Appl. No.: 644,914

[22] Filed: Jan. 22, 1991

[51] Int. Cl.[5] ..... E04D 13/10

[52] U.S. Cl. ..... 52/24

[58] Field of Search ..... 52/24-26, 52/696

[56] References Cited

U.S. PATENT DOCUMENTS 1,095,822 5/1914 Danzer ..... 52/25

FOREIGN PATENT DOCUMENTS 223795 10/1962 Austria ..... 52/24
941690 3/1956 Fed. Rep. of Germany ..... 52/25
2126082 12/1972 Fed. Rep. of Germany ..... 52/24
2517457 10/1976 Fed. Rep. of Germany ..... 52/24
2574455 6/1986 France ..... 52/24

*Primary Examiner*—Richard E. Chilcot, Jr.

*Attorney, Agent, or Firm*—Charles F. Meroni, Jr.

[57] ABSTRACT

A roof snow guard for retained assembly with a peaked type of metallic corrugated roof having transversely spaced generally vertically inclined corrugations thereon. The snow guard including an angular bar having an approximate length corresponding to the distance between peaks on the roof. A pair of channel shaped brackets are provided at opposite ends of the angular bar. Welds fixedly connect the channel shaped brackets to opposite ends of the angular bar. The channel shaped brackets each define channels for engagement over the corrugations with the channels extending generally at right angles to the angular bar. The angular bar includes a downwardly extending bar leg positioned between the channel shaped brackets and which is adapted to be positioned in vertically spaced overlying relationship to the metallic corrugated roof for inhibiting downward sliding movement of snow on the roof while allowing melted snow or rain to slide downwardly on the roof and to pass beneath the downwardly extended bar leg.

23 Claims, 2 Drawing Sheets

SNOW BLOCKING DEVICE FOR ATTACHMENT TO CORRUGATED METAL ROOFS

FIELD OF INVENTION

The present invention is directed to snow guards for corrugated metal roofs. The invention further relates to a new and improved snow guard where the components can be economically manufactured from sheet metal stock or rolled stock from corrosive resistant coated materials to resist rust.

Those types of snow guards have been known in the past and representative examples are shown in U.S. Pat. Nos. 1,095,822 and 4,141,182. In the '822 patent a relatively high profile type of snow guard is illustrated for attachment to corrugations on a metal roof. The snow guard has a pair of feet and the feet are adapted to be connected by fasteners to the tops of the corrugations on the corrugated roof. This type of a snow guard is of a high profile type in that it extends substantially above the plane of the corrugated roof and is believed to be of a more unsightly and less economical construction as compared to the new and improved snow guard herein disclosed. The snow guard shown in the '182 patent is manufactured in an injection mold of clear plastic and field reports available have indicated that there has been some tendency for this type of construction to crack and to become otherwise unsuitable for its intended purpose to act as a dam to prevent movement of snow or ice on the roof. Since the snow guard herein disclosed is constructed of more durable non-corrosive metallic materials, it is believed that the difficulties encountered in the snow guard shown in the '182 patent are eliminated.

According to my invention, my new and improved snow guard can be manufactured having a rolled metal intermediate section with channel shaped brackets welded to the intermediate section at its opposite ends from a galvanized metal or from aluminum having a corrosive resistant exterior coating. According to other features of my invention, the new and improved snow guard herein disclosed has a relative low profile when mounted on the roof so as to be effective to restrained movement of ice or snow generally at points close to where the ice or snow is supported on the roof but spaced above the roof so that water can drain without being held back by the snow guard itself.

SUMMARY OF THE INVENTION

A roof snow guard for retained assembly with a peaked type of metallic corrugated roof having transversely spaced generally vertically inclined peak shaped corrugations thereon, the snow guard including an angular bar having an approximate length corresponding to the distance between corrugations on the roof, a pair of peak shaped brackets at opposite ends of the angular bar, welds fixedly connecting the peak shaped brackets to opposite ends of the angular bar, the peak shaped brackets each defining peak shaped channels, said peak shaped channels being sized for nested engagement in gap relationship over the vertically inclined peak shaped corrugations to allow for differences in co-efficients of expansion and with the peak shaped channels extending generally at right angles to the angular bar, the angular bar including a downwardly extending bar leg positioned between the peak shaped brackets, the bar leg being positioned on the snow guard and located when installed in vertically spaced overlying relationship to the metallic corrugated roof for inhibiting downward sliding movement of snow on the roof while allowing melted snow or rain to slide downwardly on the roof and to pass beneath the downwardly extended bar leg.

According to other features of my invention, the roof snow guard has upper bracket surfaces on the channel shaped brackets, mastic tape at the area of the holes to prevent water leakage through a roof where the guard is mounted, holes are in the upper bracket surfaces, and fasteners are extended through the holes for affixing the brackets to a roof.

Still other features of my invention concern the provision of an upper bar leg on the angular bar, the welds connecting the opposite ends of the upper bar leg in integral assembly with the channel shaped brackets.

Yet other features of my invention concern the location of end surfaces on the downwardly extending bar legs such as to be positioned in flush edgewise abutment against inclined confronting bracket walls of the brackets.

According still other desired features of my invention, the guard is of a shape similar to a dumbbell with the angular bar being intermediately located and with the channel shaped brackets being positioned at opposite ends of the bar and simulating bells on a dumbbell but being open on one side with the channels being located on the open side so as to face downwardly.

Other important features of my invention relate to the peak-shaped brackets having generally downwardly extending bracket legs, fastener holes in the bracket legs, fasteners for retaining co-action with the holes in the brackets remote from the gap relationship attaching the guard to the peaked type of metallic corrugated roof.

DESCRIPTION OF A PREFERRED EMBODIMENT

Figure 1:
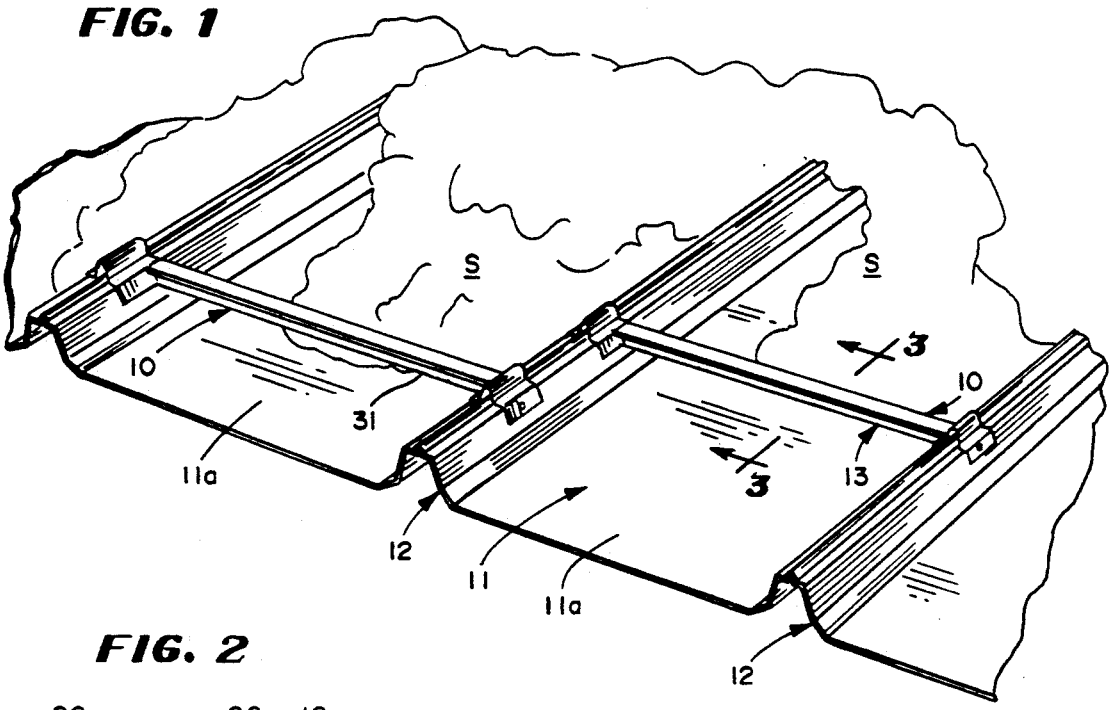
FIG. 1 is an enlarged fragmentary perspective view of my roof snow guard mounted on a peaked type of metallic corrugated roof and embodying features of my invention.

The reference numeral 10 indicates my new roof snow guard which embodies important features of my invention. The snow guard is adapted for retained assembly with a peak-type or peak-shaped of metallic corrugated roof as indicated at 11 in FIG. 1. The terms "peak-shaped" and "peak-type" are equivalent terms as used in my patent specification. The roof has transversely spaced generally vertically inclined step shaped corrugations as indicated at 12 and with a peak at an apex of each corrugation. The snow guard 10 is adapted to be mounted so as to be spaced above the roof 11 at a flat intermediate roof section 11*a* (FIGS. 1 and 3) between the roof corrugations 12—12 for blocking snow and/or ice as shown at S in FIG. 1.

The snow guard 10 includes an angular bar or intermediate guard section 13 which has an approximate length corresponding to the distance between the corrugations or peaks 12—12 on the roof 11. A pair of channel shaped brackets 14—14 are mounted at opposite ends of the angular bar 13 and welds 16 are used to attach the channel shaped brackets 14—14 in integral assembly with the angular bar 13 to provide a unitary one piece construction.

The channel shaped brackets 14—14 on each guard 10 define a downwardly opening channels 17. The brackets 14 each have a cross sectional configuration that closely approximates the cross sectional configuration of the roof corrugations or peaks 12—12 so that when the channel shaped brackets 14—14 are mounted on the roof corrugations or roof peaks 12—12, the channel shaped brackets 14—14 can be snugly engaged in nested supported assembly with.

For the purpose of securing the snow guard 10 to the roof corrugations or roof peaks 12, we have provided metal screws 18 and protective back up cushioning pads which may be in the form of a mastic tape 19 to avoid water leaks through fastener holes 20 and 21. The holes 20 and 21 are provided in downwardly extending outside bracket legs 22 of the channel shaped brackets 14—14 and are in corresponding downwardly extending corrugation legs of the roof corrugations or roof peaks 12—12 as indicated at 23—23 in FIGS. 4 and 6. When the machine screws 18 are threaded through the holes 20 and 21 and through the cushioning pad or tape 19, the channel shaped brackets on the snow guard 10 are securely attached to the corrugations 12—12 on the roof 11 as a water tight connection.

Each bracket corrugation has a pair of stepped flange portions 24–25 which are joined together by a peaked or upper ridge portion 26. The flange portions 25 carry the outer bracket legs 22—22.

Figure 6:
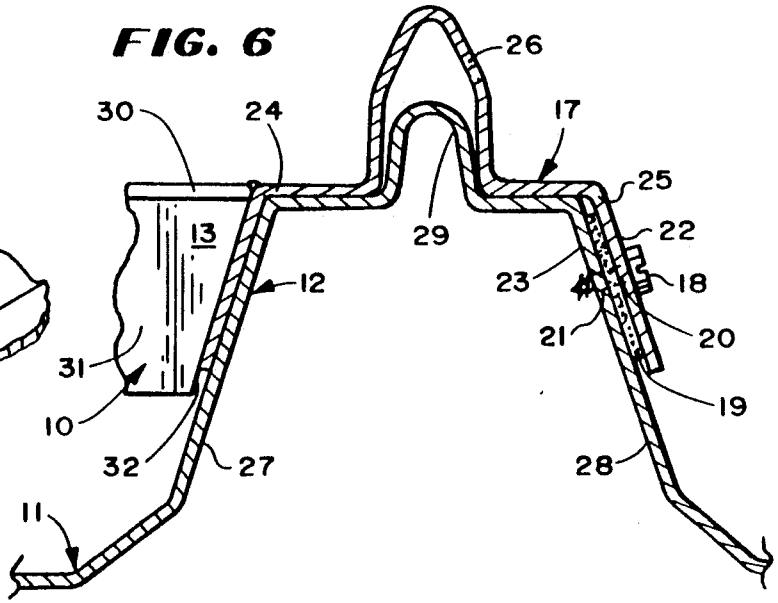
FIG. 6 is an enlarged fragmentary vertical section taken on the line 6—6 looking in the direction indicated by the arrows as seen in FIG. 5.
Figure 5:
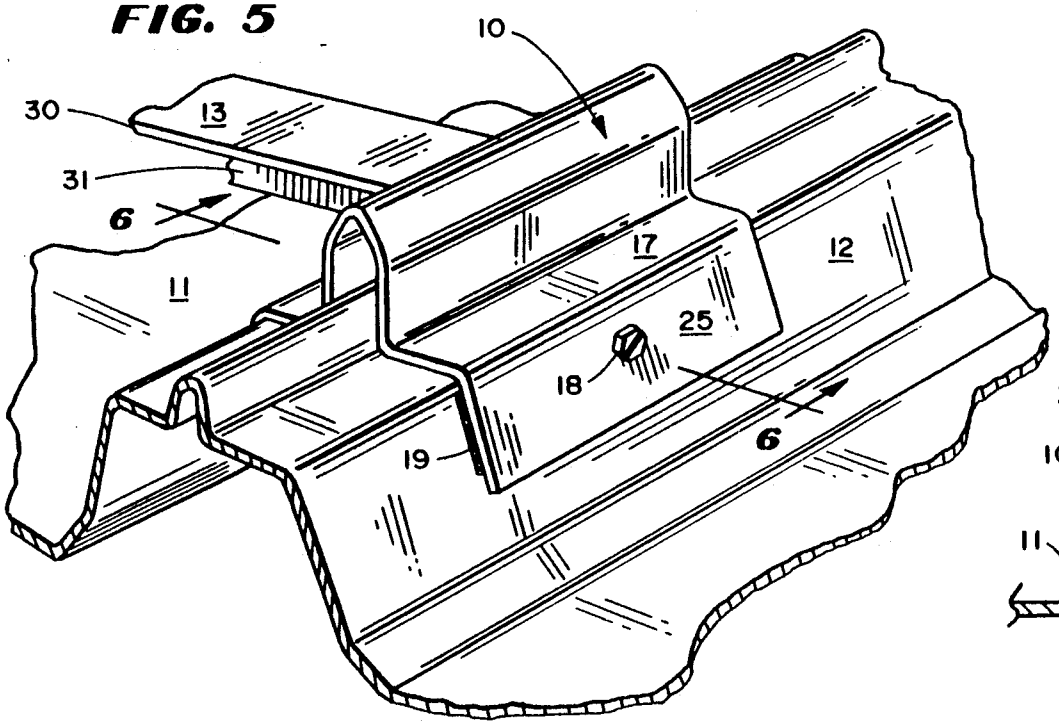
FIG. 5 is an enlarged fragmentary perspective view illustrating the manner in which a channel shaped bracket on the snow guard is mounted on a corrugation of the roof.

The roof corrugations 12 also each possess opposing stepped flange portions 27–28 and are joined by a peak or ridge 29 (FIG. 6). The roof corrugations 12 has stepped flange portions 27–28 engaged in underlying supporting relation with the snow guard bracket stepped flange portions 24–25 (FIG. 6) with ridge portion 26 enclosing and capping the roof corrugation ridges or roof peaks 29.

Figure 2:
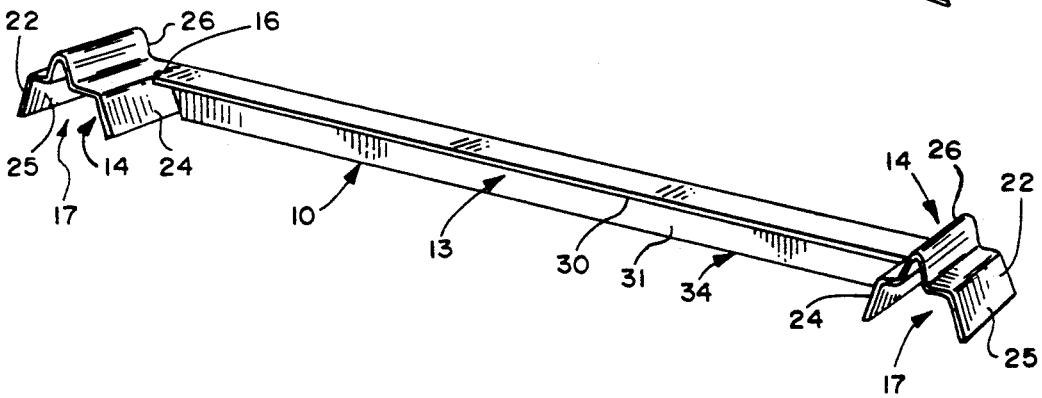
FIG. 2 is an enlarged perspective view of my roof snow guard as shown in FIG. 1.
Figure 3:
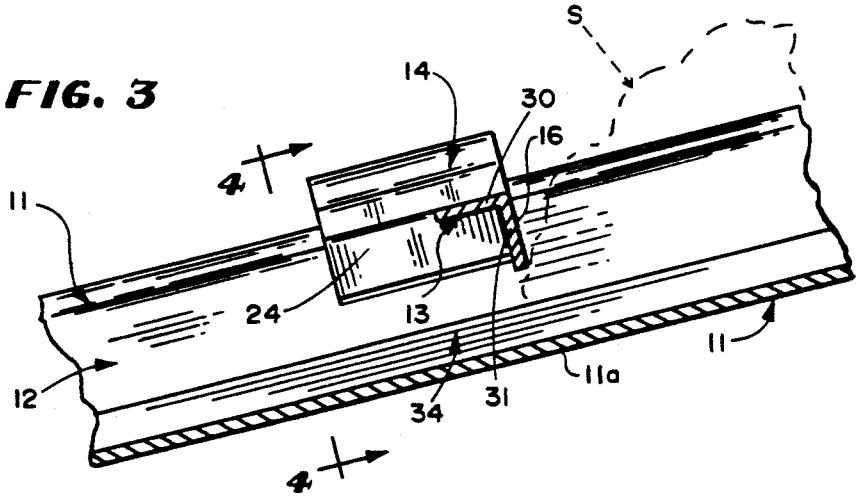
FIG. 3 is an enlarged fragmentary vertical section taken on the line 3—3 looking in the direction indicated by the arrows as seen in FIG. 1.
Figure 4:
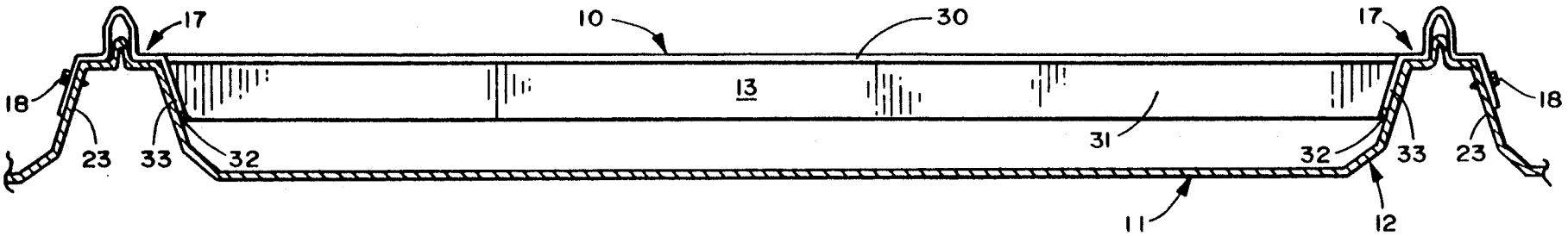
FIG. 4 is an enlarged vertical section taken on the line 4—4 looking in the direction indicated by the arrows as seen in FIG. 3.

The downwardly opening angular bars 13 each include a pair of angled bar legs 30–31. The bar leg 31 has inclined bar leg ridges 32—32 (FIG. 4). These edges 32—32 are engaged in flush engagement with inner bracket legs 33—33 and so held in permanent secured assembly by the welds 16 (FIG. 2). Only one weld 16 is shown in FIG. 2 but another similar weld (not shown) secures the other channel shaped bracket at the opposite end of the snow guard 10. It is also contemplated that the weld will be L-shaped and extend along the edge surfaces of the bar legs 30–31 as shown in FIG. 3.

We have found that excellent results can be obtained where my snow guard 10 is manufactured from a material known as "GALVALUME", which is a galvanized aluminum material. We have further found that excellent results can be obtained where the material is 18 gauge. With regards to the materials we use in manufacture, "Galvalume" or aluminum, these materials have an aluminum facing which is totally compatible with the "Galvalume" material that the manufacturers of the roof panel systems use and will not cause deterioration of the roof panels due to galvanic action caused by dissimilar metals. Also, excellent results can be attained where the snow guard has a length from peak to peak of approximately 24". Also, the angled bar legs 30 and 31 have a width of 1" each and are manufactured as a rolled metal section.

It is believed that it is important that the angled bar legs be angled downwardly in such a way that the open side of the angle extends downwardly for safety reasons so that if someone slips on the roof and reaches to grasp the angular bar nearest to that person that then the person will not be likely to be injured by any upwardly facing edges on the bar legs 30 and 31.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A roof snow guard for retained assembly with a peaked type of metallic corrugated roof having transversely spaced generally vertically inclined peak shaped corrugations thereon, the snow guard including an angular bar having an approximate length corresponding to the distance between corrugations on the roof, a pair of peak shaped brackets at opposite ends of the angular bar, welds fixedly connecting the peak shaped brackets to opposite ends of the angular bar, the peak shaped brackets each defining peak shaped channels, said peak shaped channels being sized for nested engagement in gap relationship over the vertically inclined peak shaped corrugations to allow for differences in coefficients of expansion and with the peak shaped channels extending generally at right angles to the angular bar, the angular bar including a downwardly extending bar leg positioned between the peak shaped brackets, the bar leg being positioned on the snow guard and located when installed in vertically spaced overlying relationship to the metallic corrugated roof for inhibiting downward sliding movement of snow on the roof while allowing melted snow or rain to slide downwardly on the roof and to pass beneath the downwardly extended bar leg.

2. The roof snow guard for claim 1 wherein the peak shaped brackets have upper bracket surfaces, holes in the upper bracket surfaces, mastic tape at the area of the holes to prevent water leakage through a roof where the guard is mounted, and fasteners extending through the holes for affixing the brackets to a roof.

3. The roof snow guard of claim 1 wherein the downwardly extending bar leg has end surfaces in flush edgewise abutment against inclined confronting bracket walls, said bar being of an L-shaped configuration.

4. The roof snow guard of claim 1 wherein the angular bar has an upper bar leg, said welds connecting the opposite ends of the upper bar leg in integral assembly with the peak shaped brackets.

5. The roof snow guard of claim 4 further characterized by the bar legs each being approximately 1 inch wide and with the guard being approximately 24 inches in length from a mid point of one peak shaped bracket to a mid point of another of the brackets at opposite ends of the angular bar.

6. The roof snow guard of claim 1 where the guard is of a flat shape having a low profile lying essentially within a top plane of the corrugated roof with the angular bar being intermediately located and with the peak shaped brackets being positioned at opposite ends of the bar being open on one side with the peak shaped channels being located on the open side so as to face downwardly for nested engagement with peak shaped roof corrugations.

7. The roof snow guard of claim 6 wherein the downwardly extending bar legs have end surfaces, said end surfaces being in flush edgewise abutment against inclined confronting bracket walls of said peak shaped channels.

8. The roof snow guard of claim 6 wherein the angular bar has upper and lower bar legs, said welds connecting the opposite ends of the bar legs in integral assembly with the peak shaped brackets.

9. The roof snow guard of claim 6 wherein the peak shaped brackets have side-wise facing bracket surfaces, holes in the side-wise facing bracket surfaces, mastic tape at the area of the holes to prevent water leakage through a roof where the guard is mounted, and fasteners extending through the holes for affixing the brackets to a roof.

10. The roof snow guard of claim 6 wherein the downwardly extending bar legs have end surfaces in flush edgewise abutment against inclined confronting bracket walls, the angular bar has an upper bar leg, said welds connecting the opposite ends of the upper bar leg in integral assembly with the peak shaped brackets.

11. The roof snow guard of claim 6 wherein each of the peak shaped brackets has stepped flanges on opposite sides and with the stepped flanges being joined together by a bracket peak at a mid point therebetween, the shape of the peak shaped bracket being such as to be complimentary to a corresponding shaped corrugation on a roof, thus enabling the peak shaped bracket to be supported from its bottom side along its length by the peak shaped roof corrugation associated therewith.

12. The roof snow guard of claim 1 where the guard is of a shape similar to a dumbbell with the angular bar being intermediately located and with the peak shaped brackets being positioned at opposite ends of the bar and simulating bells on a dumbbell but being open on one side with the peak shaped channels being located on the open side so as to face downwardly.

13. The roof snow guard of claim 1 wherein the peak shaped brackets have generally downwardly extending bracket legs, fastener holes in said bracket legs, fasteners for retaining co-action with said holes in said brackets remote from the gap relationship attaching the guard to the peaked type of metallic corrugated roof.

14. A roof snow guard for retained assembly with a peaked type of metallic corrugated roof having transversely spaced generally vertically inclined peak shaped corrugations thereon, the snow guard including an intermediate angular portion having an approximate length corresponding to a distance between corrugations on the roof, a pair of peak shaped bracket portions integral with opposite ends of the angular intermediate portion, the peak shaped brackets each defining peak shaped channels, said peak shaped channels being sized for engagement in gap relationship over the vertically inclined corrugations to allow for differences in co-efficients of expansion and with the channels extending generally at right angles to the angular intermediate portion, the angular intermediate portion including a downwardly extending guard leg positioned between the peak shaped brackets, the guard leg being positioned on the snow guard and located when installed in vertically spaced overlying relationship to the metallic corrugated roof for inhibiting downward sliding movement of snow on the roof while allowing melted snow or rain to slide downwardly on the roof and to pass beneath the downwardly extended bar guard.

15. The roof snow guard of claim 14 where the guard is of a flat elongated shape having a low profile line essentially within a top plane of the corrugated roof with the angular intermediate portion being positioned between the peak shaped brackets, the peak shaped brackets being open and underneath side so as to face downwardly for nested engagement with peak shaped roof corrugations.

16. The roof snow guard of claim 15 wherein the peak shaped brackets have side-wise facing bracket surfaces, holes in the side-wise facing bracket surfaces, mastic tape at the area of the holes to prevent water leakage through a roof where the guard is mounted, and fasteners extending through the holes for affixing the brackets to a roof.

17. The roof snow guard of claim 15 wherein it is manufactured from an 18 gauge aluminum material, said angular intermediate portion of said guard consisting only of an L-shaped configuration so as to fall within said low profile line as a safety measure to reduce likelihood of a person being tripped while working on an inclined roof where the guard is installed.

18. The roof snow guard of claim 14 wherein the peak shaped brackets have generally downwardly extending bracket legs, fastener holes in said bracket legs, fasteners for retaining co-action with said holes in said brackets remote from the gap relationship attaching the guard to the peaked type of metallic corrugated roof.

19. In combination, a corrugated roof, and a roof snow guard in retained assembly with the metallic corrugated roof, the roof having transversely spaced generally vertically inclined peak shaped corrugations thereon, the snow guard including an intermediate angular portion positioned between an adjacent pair of the corrugations on the roof, a pair of peak shaped bracket portions integral with opposite ends of the angular intermediate portion, the peak shaped brackets each defining peak shaped channels, said peak shaped channels being sized in gap relationship over the vertically inclined peak shaped corrugations to allow for differences in co-efficients of expansion and with the peak shaped channels extending generally at right angles to the angular intermediate portion, the angular intermediate portion including a downwardly extending guard leg positioned between the peak shaped brackets, the guard leg being positioned on the snow guard and located in vertically spaced overlying relationship to the metallic corrugated roof for inhibiting downward sliding movement of snow on the roof while allowing melted snow or rain to slide downwardly on the roof and to pass beneath the downwardly extended bar guard.

20. The combination of claim 19 where the guard is of a flat elongated shape having a low profile line essentially within a top plane of the corrugated roof with the angular intermediate portion being positioned between the peak shaped brackets, the peak shaped brackets being open on an underneath side so as to face downwardly in nested engagement with the associated ones of the peak shaped roof corrugations.

21. The combination of claim 20 wherein the peak shaped brackets have upper bracket surfaces, holes in the upper bracket surfaces, mastic tape at the area of the holes to prevent water leakage through a roof where the guard is mounted, and fasteners extending through the holes affixing the brackets to sides of the peak shaped roof corrugations on the roof for allowing roof panels when joined at the peak to move lengthwise along a peaked seam therebetween.

22. The combination of claim 21 wherein the guard is manufactured from an 18 gauge aluminum material, the bar legs each being approximately 1 inch wide and with the guard being approximately 24 inched in length from a mid point of one peak shaped bracket to a mid point of another of the brackets at an opposite end of the angular bar.

23. The roof snow guard of claim 19 wherein the peak shaped brackets have generally downwardly extending bracket legs, fastener holes in said bracket legs, fasteners for retaining co-action with said holes in said brackets remote from the gap relationship attaching the guard to the peaked type of metallic corrugated roof.

* * * * *